US009175579B2

(12) United States Patent
Franks et al.

(10) Patent No.: US 9,175,579 B2
(45) Date of Patent: Nov. 3, 2015

(54) LOW-DUCTILITY TURBINE SHROUD

(75) Inventors: Michael John Franks, Cincinnati, OH (US); Jason David Shapiro, Lynn, MA (US); Samuel Ross Rulli, Gloucester, MA (US); Roger Lee Doughty, Pleasant Plain, OH (US); Joshua Brian Jamison, Liberty Township, OH (US)

(73) Assignee: General Electric Company, Schenectady, NY (US)

( * ) Notice: Subject to any disclaimer, the term of this patent is extended or adjusted under 35 U.S.C. 154(b) by 456 days.

(21) Appl. No.: 13/402,616

(22) Filed: Feb. 22, 2012

(65) Prior Publication Data

US 2013/0156556 A1 Jun. 20, 2013

Related U.S. Application Data

(63) Continuation-in-part of application No. 13/327,349, filed on Dec. 15, 2011.

(51) Int. Cl.

| | |
|---|---|
| ***F01D 11/08*** | (2006.01) |
| ***F01D 25/24*** | (2006.01) |
| ***F01D 5/28*** | (2006.01) |
| *F01D 11/24* | (2006.01) |

(52) U.S. Cl.

CPC ..... *F01D 25/246* (2013.01); *F01D 5/284* (2013.01); *F01D 11/08* (2013.01); *F01D 11/24* (2013.01); *F05D 2240/11* (2013.01); *F05D 2250/41* (2013.01); *F05D 2250/61* (2013.01); *F05D 2250/712* (2013.01); *F05D 2260/38* (2013.01); *F05D 2300/6033* (2013.01)

(58) Field of Classification Search

USPC ..... 415/173.1

See application file for complete search history.

(56) References Cited

U.S. PATENT DOCUMENTS

| | | | | |
|---|---|---|---|---|
| 3,583,824 | A | | 6/1971 | Smuland et al. |
| 4,087,199 | A | * | 5/1978 | Hemsworth et al. ..... 415/173.3 |
| 5,074,748 | A | | 12/1991 | Hagle |
| 5,154,577 | A | | 10/1992 | Kellock et al. |
| 5,188,507 | A | | 2/1993 | Sweeney |
| 5,655,876 | A | | 8/1997 | Rock et al. |
| 6,290,459 | B1 | | 9/2001 | Correia |

(Continued)

FOREIGN PATENT DOCUMENTS

| | | | |
|---|---|---|---|
| CA | 2740538 | A1 | 11/2011 |
| CN | 101372902 | A | 2/2009 |
| EP | 1965030 | | 9/2008 |

OTHER PUBLICATIONS

Marusko, et al.; U.S. Appl. No. 12/790,209, filed May 28, 2010.

(Continued)

*Primary Examiner* — Richard Edgar

(74) *Attorney, Agent, or Firm* — General Electric Company; William Scott Andes

(57) ABSTRACT

A shroud segment for a gas turbine engine, the shroud segment constructed from a composite material including reinforcing fibers embedded in a matrix, and having a cross-sectional shape defined by opposed forward and aft walls, and opposed inner and outer walls, the walls extending between opposed first and second end faces, wherein the inner wall defines an arcuate inner flowpath surface; and wherein a compound fillet is disposed at a junction between first and second ones of the walls, the compound fillet including first and second portions, the second portion having a concave curvature extending into the first one of the walls.

18 Claims, 7 Drawing Sheets

(56) References Cited

U.S. PATENT DOCUMENTS

| | | | | |
|---|---|---|---|---|
| 6,340,285 | B1 | 1/2002 | Gonyou et al. | |
| 6,413,042 | B2 | 7/2002 | Correia | |
| 6,503,051 | B2 | 1/2003 | Predmore | |
| 6,702,550 | B2 * | 3/2004 | Darkins et al. | 415/139 |
| 7,011,493 | B2 * | 3/2006 | Marchi et al. | 415/116 |
| 7,270,518 | B2 * | 9/2007 | Barb et al. | 416/191 |
| 7,278,820 | B2 | 10/2007 | Keller | |
| 7,563,071 | B2 * | 7/2009 | Campbell et al. | 415/173.1 |
| 7,595,114 | B2 | 9/2009 | Meschter et al. | |
| 7,686,577 | B2 | 3/2010 | Morrison et al. | |
| 7,749,565 | B2 | 7/2010 | Johnson et al. | |
| 7,910,172 | B2 | 3/2011 | Meschter et al. | |
| 7,950,234 | B2 * | 5/2011 | Radonovich et al. | 60/753 |
| 7,968,217 | B2 | 6/2011 | Sarrafi-Nour et al. | |
| 8,047,773 | B2 | 11/2011 | Bruce et al. | |
| 2003/0202876 | A1 | 10/2003 | Jasklowski et al. | |
| 2004/0062640 | A1 | 4/2004 | Darkins, Jr. et al. | |
| 2005/0129499 | A1 | 6/2005 | Morris et al. | |
| 2008/0206046 | A1 | 8/2008 | Razzell et al. | |
| 2011/0182720 | A1 | 7/2011 | Kojima et al. | |
| 2011/0274538 | A1 | 11/2011 | Shi et al. | |
| 2011/0318171 | A1 | 12/2011 | Albers et al. | |
| 2013/0017057 | A1 | 1/2013 | Lagueux | |

OTHER PUBLICATIONS

Dziech et al.; U.S. Appl. No. 12/895,007, filed Sep. 30, 2010.
Albers et al.; U.S. Appl. No. 12/915,424, filed Oct. 29, 2010.
Albers et al.; U.S. Appl. No. 12/982,082, filed Dec. 30, 2010.
Albers et al.; U.S. Appl. No. 12/982,105, filed Dec. 30, 2010.
Albers et al.; U.S. Appl. No. 13/173,897, filed Jun. 30, 2011.
Non-Final Rejection towards corresponding U.S. Appl. No. 13/327,349 dated Jul. 22, 2014.
Unofficial English translation of Office Action issued in connection with corresponding CN Application No. 201210541477.1 on May 12, 2015.
Unofficial English translation of Chinese Office Action issued in connection with corresponding CN Application No. 2012105414771 on May 12, 2015.
Unofficial English Translation of Chinese Office Action issued in connection with corresponding CN Application No. 201310056712.0 on Jun. 19, 2015.

* cited by examiner

LOW-DUCTILITY TURBINE SHROUD

CROSS-REFERENCE TO RELATED APPLICATIONS

This application is a Continuation-In-Part of application Ser. No. 13/327,349, filed Dec. 15, 2011, which is currently pending.

BACKGROUND OF THE INVENTION

This invention relates generally to gas turbine engines, and more particularly to shrouds made of a low-ductility material in the turbine sections of such engines.

A typical gas turbine engine includes a turbomachinery core having a high pressure compressor, a combustor, and a high pressure turbine in serial flow relationship. The core is operable in a known manner to generate a primary gas flow. The high pressure turbine (also referred to as a gas generator turbine) includes one or more rotors which extract energy from the primary gas flow. Each rotor comprises an annular array of blades or buckets carried by a rotating disk. The flowpath through the rotor is defined in part by a shroud, which is a stationary structure which circumscribes the tips of the blades or buckets. These components operate in an extremely high temperature environment, and must be cooled by air flow to ensure adequate service life. Typically, the air used for cooling is extracted (bled) from the compressor. Bleed air usage negatively impacts specific fuel consumption ("SFC") and should generally be minimized.

It has been proposed to replace metallic shroud structures with materials having better high-temperature capabilities, such as ceramic matrix composites (CMCs). These materials have unique mechanical properties that must be considered during design and application of an article such as a shroud segment. For example, CMC materials have relatively low tensile ductility or low strain to failure when compared with metallic materials. Also, CMCs have a coefficient of thermal expansion ("CTE") in the range of about 1.5-5 microinch/inch/degree F., significantly different from commercial metal alloys used as supports for metallic shrouds. Such metal alloys typically have a CTE in the range of about 7-10 microinch/inch/degree F.

CMC materials are comprised of a laminate of a matrix material and reinforcing fibers and are orthotropic to at least some degree. The matrix, or non-primary fiber direction, herein referred to as interlaminar, is typically weaker (i.e. 1/10 or less) than the fiber direction of a composite material system and can be the limiting design factor.

Shroud structures are subject to interlaminar tensile stress imparted at the junctions between their walls, which must be carried in the weaker matrix material. These interlaminar tensile stresses can be the limiting stress location in the shroud design.

Accordingly, there is a need for a composite shroud structure with reduced interlaminar stresses.

BRIEF DESCRIPTION OF THE INVENTION

This need is addressed by the present invention, which provides a shroud segment configured so as to minimize interlaminar stresses therein.

According to one aspect of the invention, a shroud segment is provided for a gas turbine engine, the shroud segment constructed from a composite material including reinforcing fibers embedded in a matrix, and having a cross-sectional shape defined by opposed forward and aft walls, and opposed inner and outer walls, the walls extending between opposed first and second end faces, wherein the inner wall defines an arcuate inner flowpath surface; and wherein a compound fillet is disposed at a junction between first and second ones of the walls, the compound fillet including first and second portions, the second portion having a concave curvature extending into the first one of the walls.

According to another aspect of the invention, a shroud apparatus for a gas turbine engine includes: an annular metallic hanger; a shroud segment disposed inboard of the hanger, the shroud segment constructed from a composite material including reinforcing fibers embedded in a matrix, and having a cross-sectional shape defined by opposed forward and aft walls, and opposed inner and outer walls, the walls extending between opposed first and second end faces, wherein the inner wall defines an arcuate inner flowpath surface; and wherein a compound fillet is disposed at a junction between first and second ones of the walls, the compound fillet including first and second portions, the second portion having a concave curvature extending into the first one of the walls; and a retainer mechanically coupled to the hanger which engages the shroud segment to retain the shroud segment to the hanger while permitting movement of the shroud segment in a radial direction.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
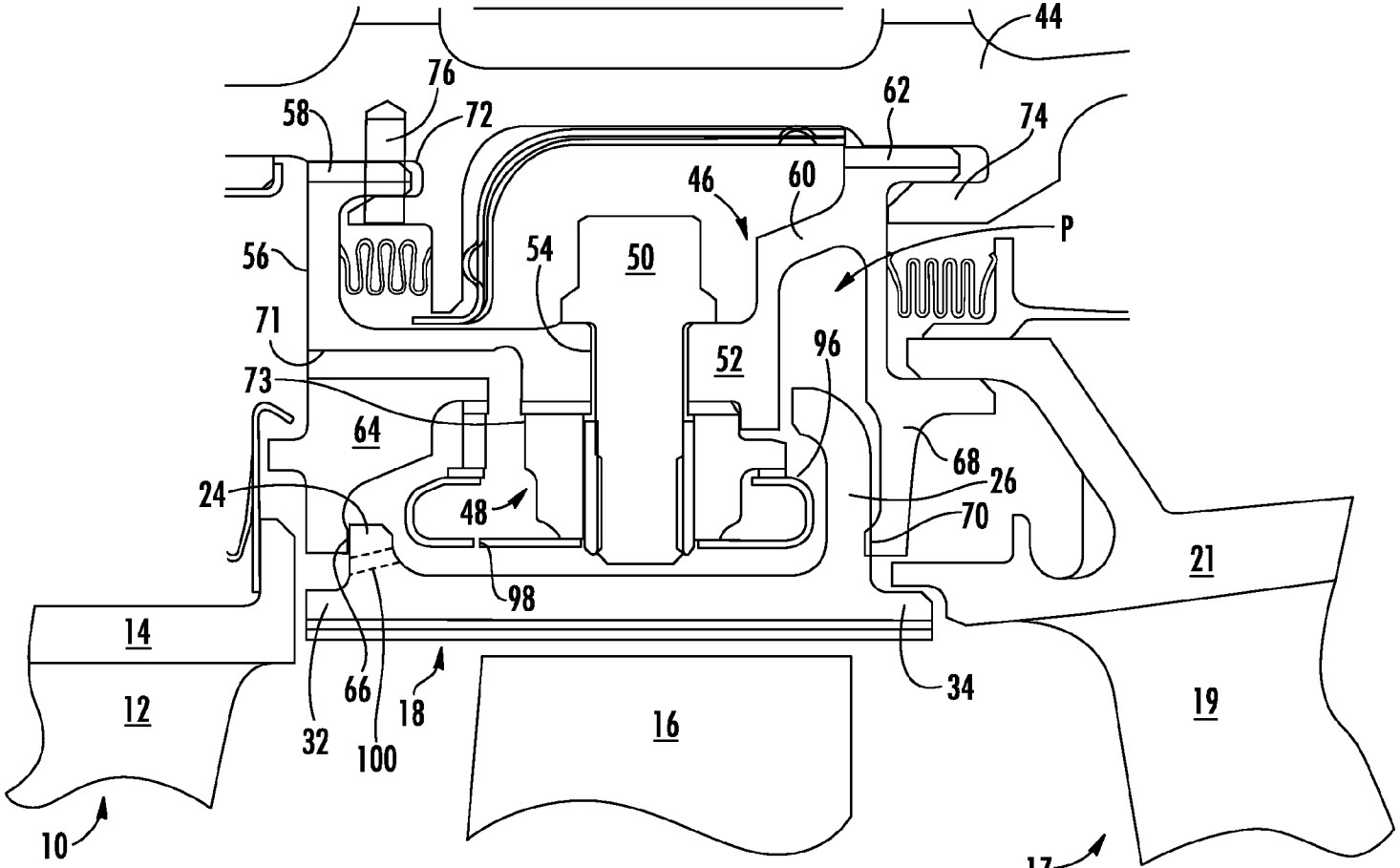
FIG. 1 is a schematic cross-sectional view of a portion of a turbine section of a gas turbine engine, incorporating a shroud mounting apparatus constructed in accordance with an aspect of the present invention.

Referring to the drawings wherein identical reference numerals denote the same elements throughout the various views, FIG. 1 depicts a small portion of a turbine, which is part of a gas turbine engine of a known type. The function of the turbine is to extract energy from high-temperature, pressurized combustion gases from an upstream combustor (not shown) and to convert the energy to mechanical work, in a known manner. The turbine drives an upstream compressor (not shown) through a shaft so as to supply pressurized air to the combustor.

The principles described herein are equally applicable to turbofan, turbojet and turboshaft engines, as well as turbine engines used for other vehicles or in stationary applications. Furthermore, while a turbine shroud is used as an example, the principles of the present invention are applicable to any low-ductility flowpath component which is at least partially exposed to a primary combustion gas flowpath of a gas turbine engine.

The turbine includes a stationary nozzle 10. It may be of unitary or built-up construction and includes a plurality of airfoil-shaped stationary turbine vanes 12 circumscribed by an annular outer band 14. The outer band 14 defines the outer radial boundary of the gas flow through the turbine nozzle 10. It may be a continuous annular element or it may be segmented.

Downstream of the nozzle 10, there is a rotor disk (not shown) that rotates about a centerline axis of the engine and carries an array of airfoil-shaped turbine blades 16. A shroud comprising a plurality of arcuate shroud segments 18 is arranged so as to encircle and closely surround the turbine blades 16 and thereby define the outer radial flowpath boundary for the hot gas stream flowing through the turbine blades 16.

Downstream of the turbine blades 16, there is a downstream stationary nozzle 17. It may be of unitary or built-up construction and includes a plurality of airfoil-shaped stationary turbine vanes 19 circumscribed by an annular outer band 21. The outer band 21 defines the outer radial boundary of the gas flow through the turbine nozzle 17. It may be a continuous annular element or it may be segmented.

Figure 2:
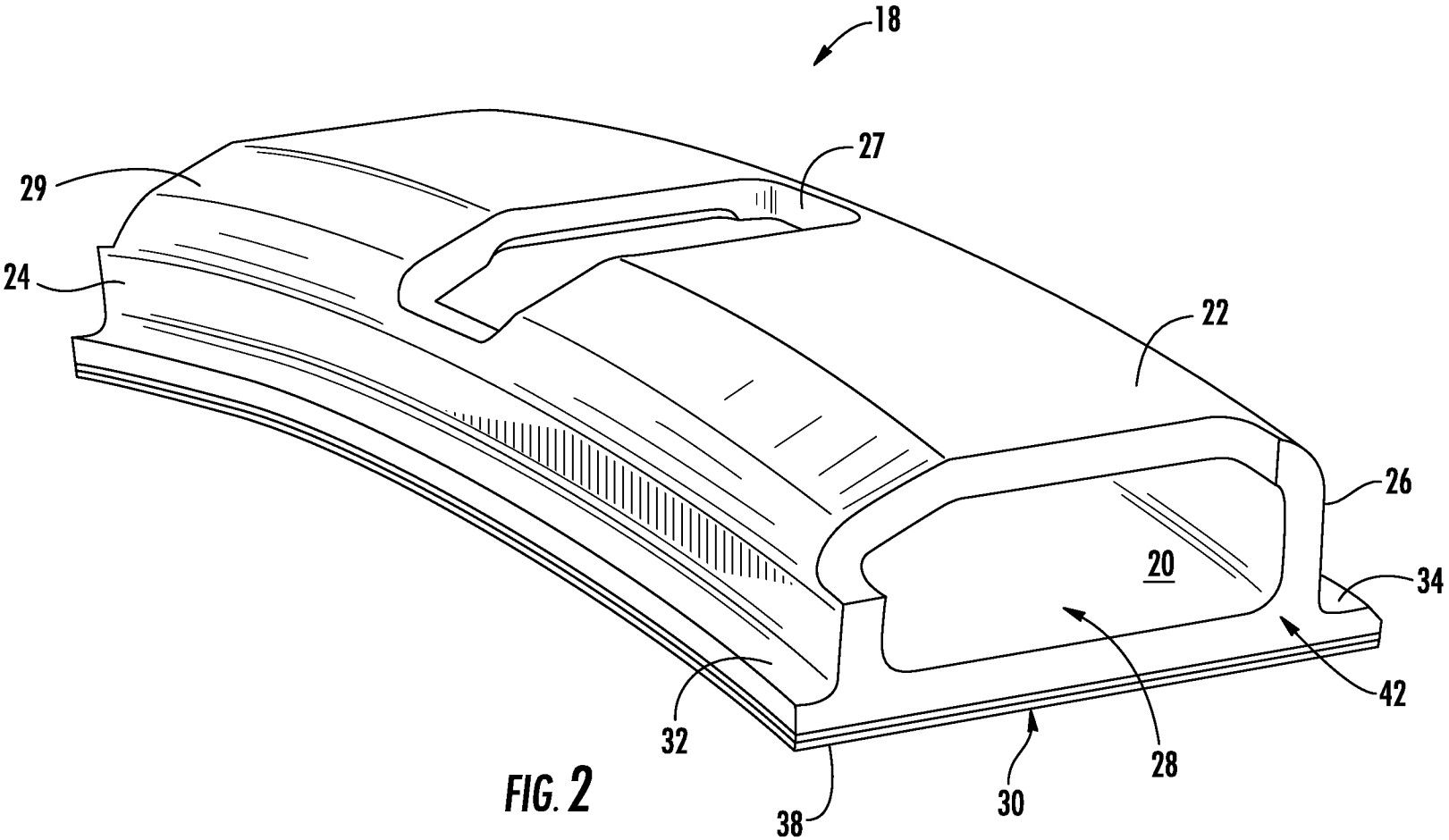
FIG. 2 is a schematic perspective view of a shroud segment seen in FIG. 1.

As seen in FIG. 2, each shroud segment 18 has a generally hollow cross-sectional shape defined by opposed inner and outer walls 20 and 22, and forward and aft walls 24 and 26. Radiused, sharp, or square-edged transitions may be used at the intersections of the walls. A shroud cavity 28 is defined within the walls 20, 22, 24, and 26. A transition wall 29 extends at an angle between the forward wall 24 and the outer wall 22, and lies at an acute angle to a central longitudinal axis of the engine when viewed in cross-section. An axially-elongated mounting slot 27 passes through the outer wall 22, the transition wall 29, and the forward wall 24. The inner wall 20 defines an arcuate radially inner flowpath surface 30. The inner wall 20 extends axially forward past the forward wall 24 to define a forward flange or overhang 32 and it also extends axially aft past the aft wall 26 to define an aft flange or overhang 34. The flowpath surface 30 follows a circular arc in elevation view (e.g. forward looking aft or vice-versa).

The shroud segments 18 are constructed from a ceramic matrix composite (CMC) material of a known type. Generally, commercially available CMC materials include a ceramic type fiber for example SiC, forms of which are coated with a compliant material such as Boron Nitride (BN). The fibers are carried in a ceramic type matrix, one form of which is Silicon Carbide (SiC). Typically, CMC type materials have a room temperature tensile ductility of no greater than about 1%, herein used to define and mean a low tensile ductility material. Generally CMC type materials have a room temperature tensile ductility in the range of about 0.4 to about 0.7%. This is compared with metals having a room temperature tensile ductility of at least about 5%, for example in the range of about 5 to about 15%. The shroud segments 18 could also be constructed from other low-ductility, high-temperature-capable materials.

CMC materials are orthotropic to at least some degree, i.e. the material's tensile strength in the direction parallel to the length of the fibers (the "fiber direction") is stronger than the tensile strength in the perpendicular direction (the "matrix", "interlaminar", or "secondary" or "tertiary" fiber direction). Physical properties such as modulus and Poisson's ratio also differ between the fiber and matrix directions.

The flowpath surface 30 of the shroud segment 18 may incorporate a layer of environmental barrier coating ("EBC"), which may be an abradable material, and/or a rub-tolerant material of a known type suitable for use with CMC materials. This layer is sometimes referred to as a "rub coat", designated at 38. As used herein, the term "abradable" implies that the rub coat 38 is capable of being abraded, ground, or eroded away during contact with the tips of the turbine blades 16 as they turn inside the shroud segments 18 at high speed, with little or no resulting damage to the turbine blade tips. This abradable property may be a result of the material composition of the rub coat 38, by its physical configuration, or by some combination thereof. The rub coat 38 may comprise a ceramic layer, such as yttria stabilized zirconia or barium strontium aluminosilicate. Exemplary compositions and methods suitable for making the rub coat 38 are described in U.S. Pat. No. 7,749,565 (Johnson et al.), which is incorporated herein by reference.

Figure 3:
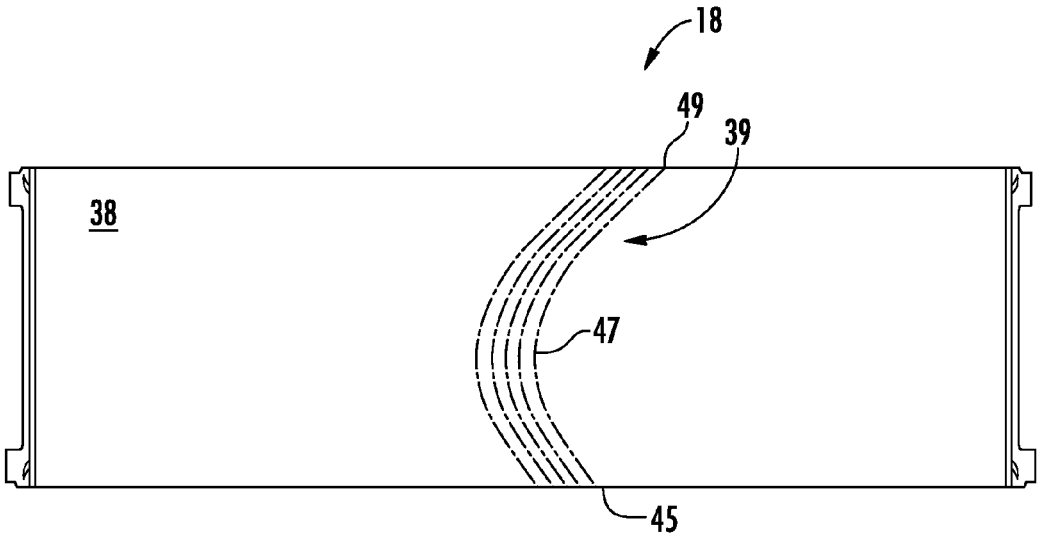
FIG. 3 is a bottom view of the shroud segment of FIG. 2.
Figure 4:
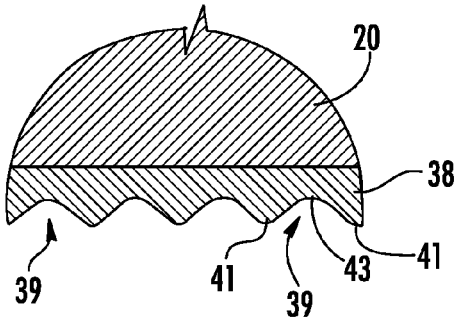
FIG. 4 is an enlarged view of a portion of FIG. 3.

FIGS. 3 and 4 depict the rub coat 38 in more detail. In the illustrated example, the rub coat 38 is patterned. The pattern enhances abradability of the rub coat by decreasing the surface area exposed to contact with the tips of the turbine blades 16. Specifically, the rub coat 38 has a plurality of side-by-side grooves 39 formed therein. The presence of the grooves 39 gives the surface a shape comprising alternate peaks 41 and valleys 43. The grooves 39 run generally in a fore-to-aft direction, and each groove 39 has a forward end 45, a central portion 47, and an aft end 49, In plan view, the grooves 39 may be curved. For example, as shown in FIG. 3, each groove 39 is curved such that its central portion 47 is offset in a lateral or tangential direction relative to its forward and aft ends 45 and 49.

The shroud segments 18 include opposed end faces 42 (also commonly referred to as "slash" faces). The end faces 42 may lie in a plane parallel to the centerline axis of the engine, referred to as a "radial plane", or they may be slightly offset from the radial plane, or they may be oriented so that they are at an acute angle to such a radial plane. When assembled into a complete ring, end gaps are present between the end faces 42 of adjacent shroud segments 18. One or more seals (not shown) may be provided at the end faces 42. Similar seals are generally known as "spline seals" and take the form of thin strips of metal or other suitable material which are inserted in slots in the end faces 42. The spline seals span the gaps between shroud segments 18.

Figure 6:
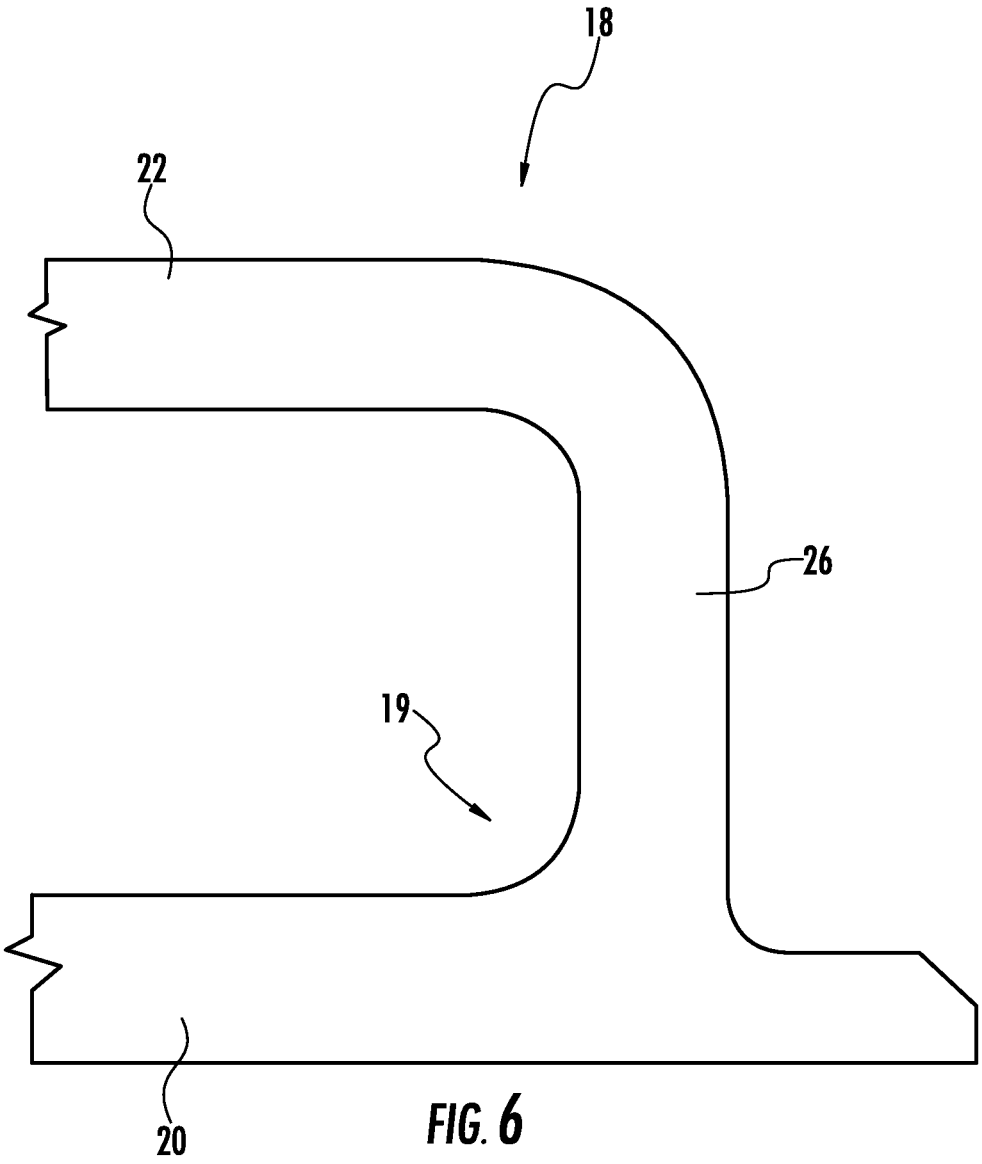
FIG. 6 is a sectional view of a portion of a shroud segment shown in FIG. 1.

FIG. 6 illustrates the interior construction of the shroud segment 18 in more detail. There is a concave fillet 19 present between the inner wall 22 and the aft wall 26. This fillet 19 is representative of the junctions present at each of the four intersections where two of the four walls meet each other. In operation, this type of configuration can experience a peak interlaminar tensile stress below the surface of the material, near the location of the fillet 19, which must be carried in the weaker matrix material. This can be the limiting stress location in the design of the shroud segment 18.

Figure 7:
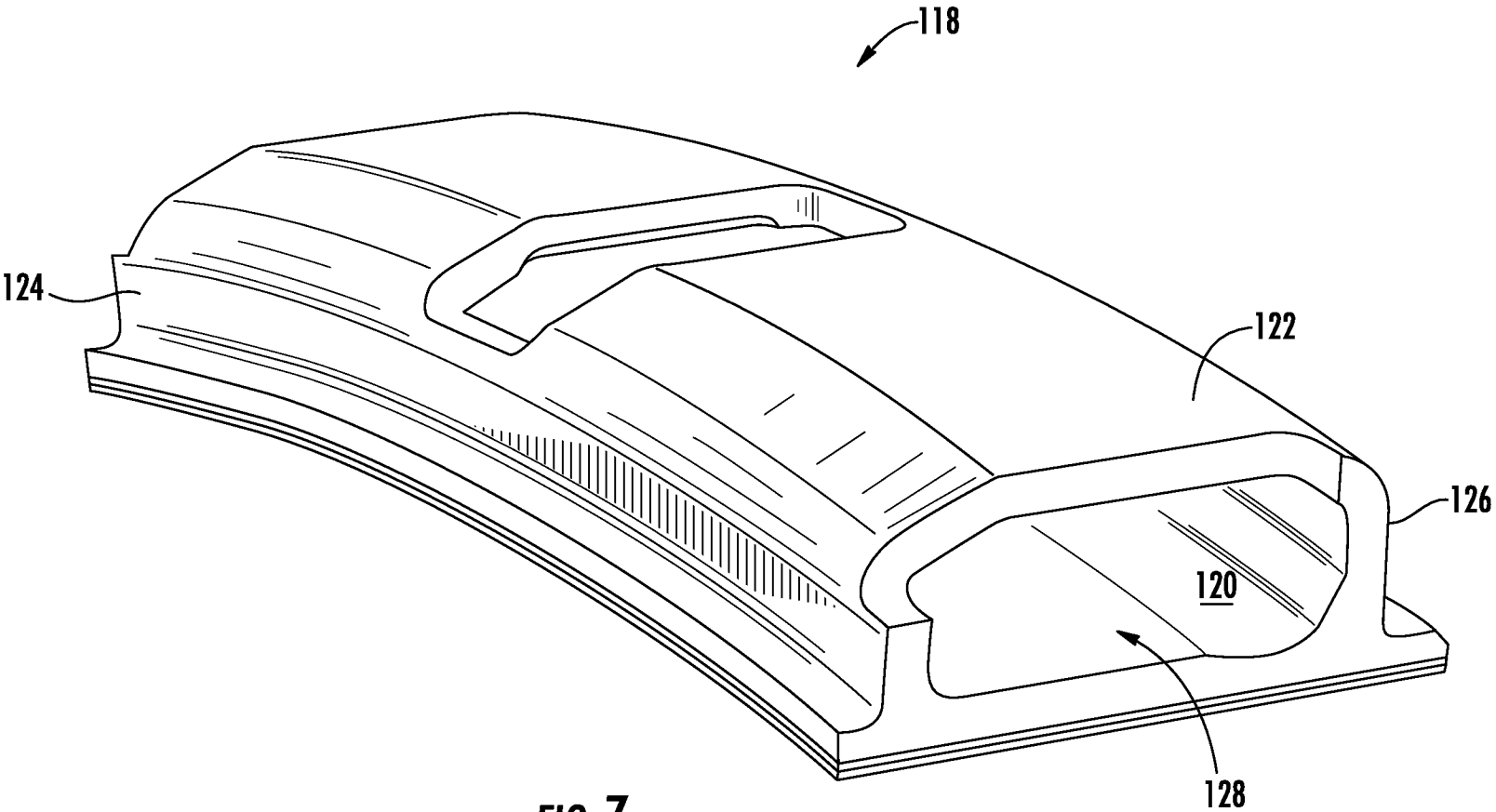
FIG. 7 is a sectional view of a portion of an alternative shroud segment shown in FIG. 1.

FIG. 7 illustrates an alternative shroud segment 118. The basic configuration is similar to that of the shroud segment 18, but the shroud segment 118 is configured to reduce the interlaminar stresses in the composite material. It has a generally hollow cross-sectional shape defined by opposed inner and outer walls 120 and 122, and forward and aft walls 124 and 126. A shroud cavity 128 is defined within the walls 120, 122, 124, and 126. A compound fillet 119 is present between the inner wall 122 and the aft wall 126. This fillet 119 is representative of the junctions present at each of the four intersections where two of the four walls meet each other.

Figure 8:
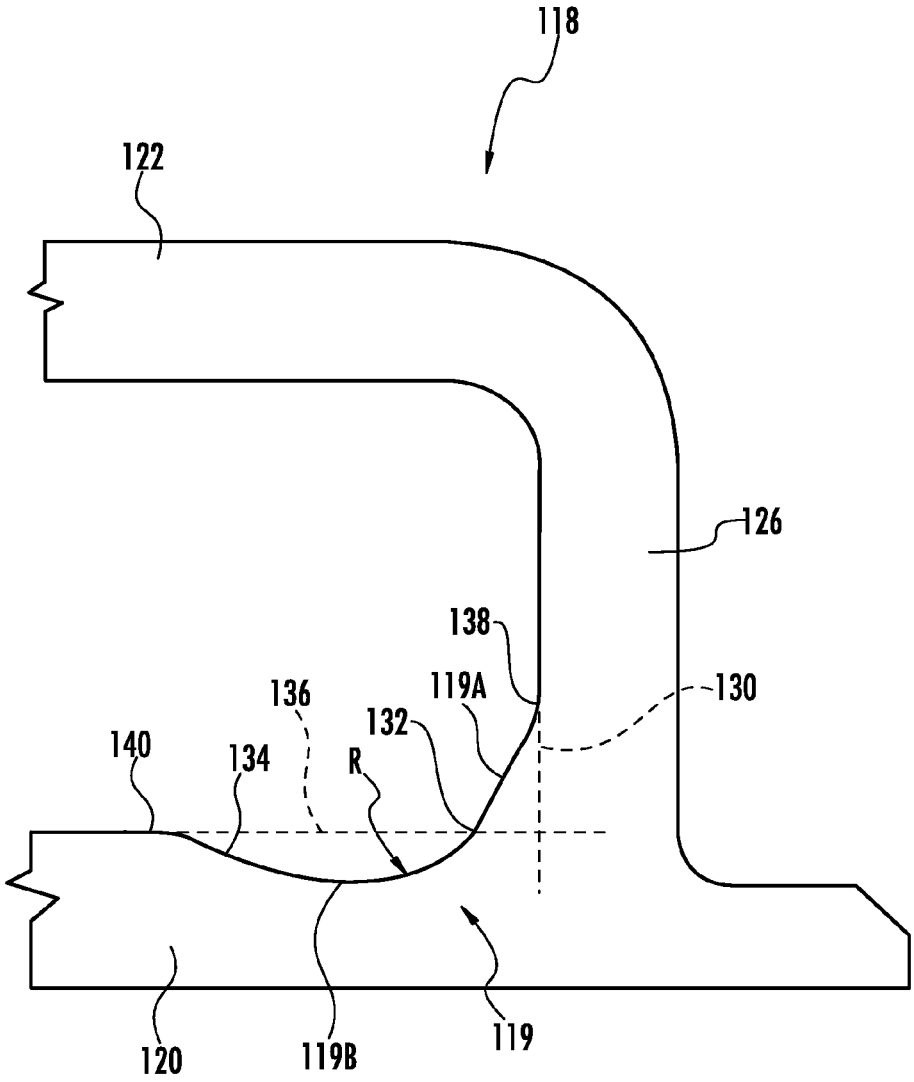
FIG. 8 is a sectional view of a portion of the shroud segment shown in FIG. 7.

As best seen in FIG. 8, the compound fillet 119 includes a first portion 119A which has a surface disposed at an acute angle to the interior surface of the aft wall 126 and the interior surface of the inner wall 120. The surface of the first portion 119A may be generally flat. The first portion 119A represents an addition of material relative to the nominal thickness of the aft wall 126, as seen by the location of the dashed line 130. The compound fillet 119 also includes a second portion 119B which is concave-curved surface having a radius R. A first end 132 of the second portion 119B meets the first portion 119A, and a second end 134 of the second portion 119B meets and transitions to the interior surface of the inner wall 120. The second portion 119B represents a subtraction of material relative to the nominal thickness of the aft wall 126, as seen by the location of the dashed line 136. The compound fillet 119, particularly the second portion 119B, may be considered an "undercut" or "thinning" preceding or adjacent to a concentrated interlaminated stress region.

At the junction of the first portion 119A and the interior surface of the aft wall 126, there is a first transition surface 138, which is illustrated as a smooth concave curve. Other configurations which could produce similar results include straight lines or spline shapes.

A second transition portion 140 is disposed at the junction of the second portion 119B and the interior surface of the inner wall 120, which is illustrated as a smooth convex curve. Other configurations which could produce similar results include straight lines or spline shapes.

The profile of the compound fillet 119 is shaped so as to be compatible with composite materials. The reinforcing fibers within the component generally follow the contours of (i.e. are parallel to) the bounding surfaces of the interior wall 120, the compound fillet 119, and the aft wall 126. These surfaces are contoured such that the fibers will not buckle or wrinkle where outward cusps are located. While the profile of the compound fillet 119 has been illustrated in an exemplary two-dimensional sectional view, it is noted that the actual shape may be different at different sections.

In the illustrated example, the thickness of the inner wall 120 is at a minimum at the location of the second portion 119B of the compound fillet 119. The exact shapes and dimensions of the compound fillet 119 may be altered to suit a particular application and the specific composite material used.

The compound fillet 119 has been illustrated disposed between the aft wall 126 and the forward wall 120. It is noted that the same or similar configuration may be implemented at the junctions between any or all of the walls 120, 122, 124, and 126.

The shroud segments 18 are mounted to a stationary metallic engine structure, shown in FIG. 1. In this example the stationary structure is part of a turbine case 44. The ring of shroud segments 18 is mounted to an array of arcuate shroud hangers 46 by way of an array of retainers 48 and bolts 50.

Figure 5:
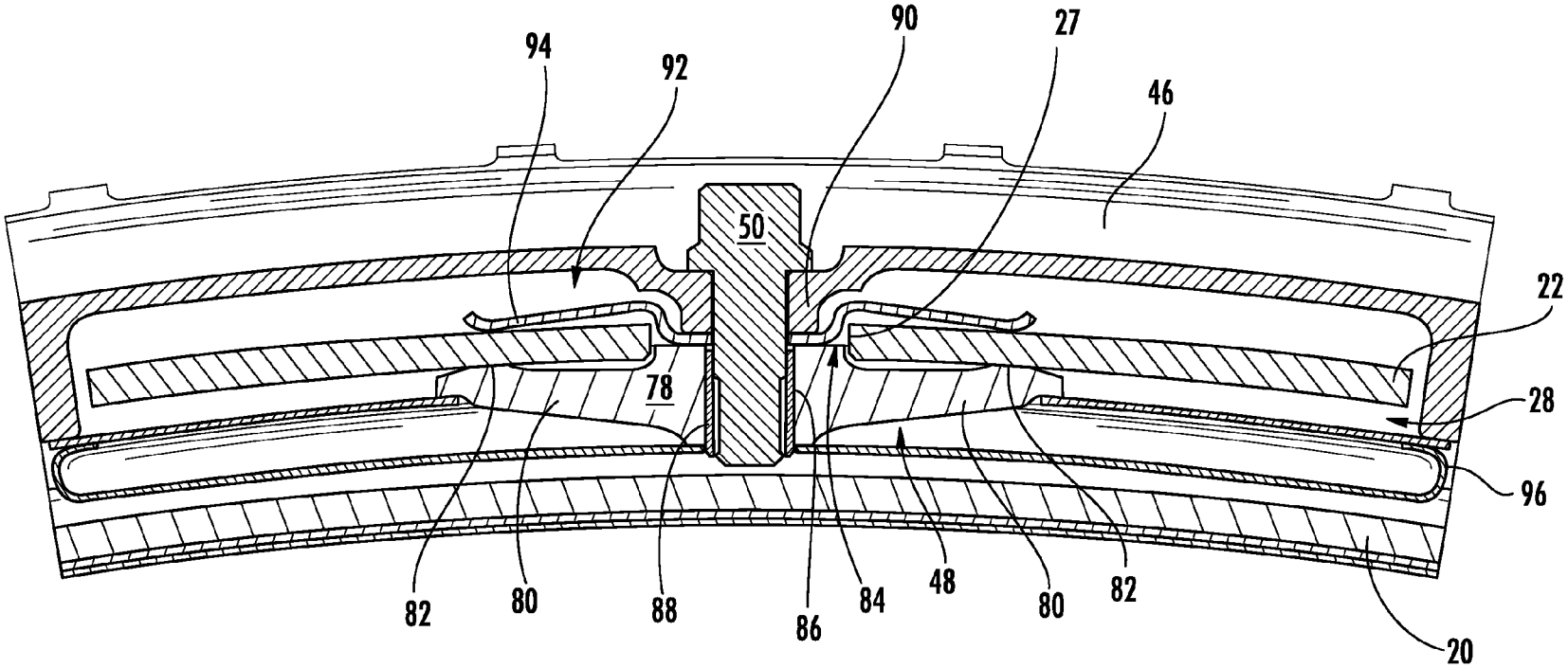
FIG. 5 is a sectional front elevation view of a portion of the turbine section shown in FIG. 1.

As best seen in FIGS. 1 and 5, each hanger 46 includes an annular body 52 which extends in a generally axial direction. The body 52 is angled such that its forward end is radially inboard of its aft end. It is penetrated at intervals by radially-aligned bolt holes 54. An annular forward outer leg 56 is disposed at the forward end of the body 52. It extends in a generally radial direction outboard of the body 52, and includes a forward hook 58 which extends axially aft. An annular aft outer leg 60 is disposed at the aft end of the body 52. It extends in a generally radial direction outboard of the body 52, and includes an aft hook 62 which extends axially aft. An annular forward inner leg 64 is disposed at the forward end of the body 52. It extends in a generally radial direction inboard of the body 52, and includes an aft-facing, annular forward bearing surface 66. An annular aft inner leg 68 is disposed at the aft end of the body 52. It extends in a generally radial direction inboard of the body 52, and includes a forward-facing, annular aft bearing surface 70. As will be explained in more detail below, the aft inner leg 68 is configured to function as a spring element. The body 52 has one or more coolant feed passages 71 formed therein which serve to receive coolant from a source within the engine (such as compressor bleed air) and route the coolant to the inboard side of the body 52.

The hangers 46 are installed into the turbine case 44 as follows. The forward hook 58 is received by an axially-forward facing forward rail 72 of the case 44. The aft hook 62 is received by an axially-forward facing aft rail 74 of the case 44. An anti-rotation pin 76 or other similar anti-rotation feature is received in the forward rail 72 and extends into a mating slot (not shown) in the forward hook 58.

The construction of the retainers 48 is shown in more detail in FIG. 5. Each retainer 48 has a central portion 78 with two laterally-extending arms 80. The distal end of each arm 80 includes a concave-curved contact pad 82 which protrudes radially outward relative to the remainder of the arm 80. The central portion 78 is raised above the arms 80 in the radial direction and defines a clamping surface 84. A radially-aligned bore 86 extends through the central portion 78. A generally tubular insert 88 is swaged or otherwise secured to the bore 86 and includes a threaded fastener hole. Optionally, the bore 86 could be threaded and the insert 88 eliminated.

The retainer 48 is positioned in the shroud cavity 28 with the central portion 78 and the clamping surface 84 exposed through the mounting hole 27 in the outer wall 22. The retainer 48 is clamped against a boss 90 of the hanger 46 by the bolt 50 or other suitable fastener, and a spring 92 is clamped between the boss 90 and the clamping surface. Each spring 92 includes a center section with a mounting hole, and opposed laterally-extending arms 94.

The relative dimensions of the boss 90, the retainer 48, and the shroud segment 18 are selected such that the retainers 48 limit the inboard movement of the shroud segments 18, but do not clamp the shroud segments 18 against the hanger 46 in the radial direction. In other words, the retainers 48 permit a definite clearance for movement in the radially outboard direction. In operation, the prevailing gas pressure load in the secondary flowpath urges the shroud segment 18 radially inboard against the retainer 48, while the retainer 48 deflects a small amount.

The springs 92 function to hold the shroud segments 18 radially inboard against the retainers 48 during assembly and for an initial grinding process to circularize the ring of shroud segments 18. However, the springs 92 are sized such that they do not exert a substantial clamping load on the shroud segments 18.

In the axial direction, the aft inner leg 68 of the hanger 46 acts as a large cantilevered spring to counteract air pressure loads in operation. This spring action urges the forward wall 24 of the shroud segment 18 against the forward bearing surface 66 of the forward inner leg 64, resulting in a positive seal between the metallic hanger 46 and the CMC shroud segments, thereby decreasing cooling flow leakage.

In the installed condition, the forward and aft overhangs 32 and 34 are disposed in axially close proximity or in axially overlapping relationship with the components forward and aft of the shroud segment 18. In the illustrated example, there is an overlapping configuration between the aft overhang 34 and the aft nozzle band 21, while the forward overhang 32 lies in close proximity to the forward outer band 14. This configuration minimizes leakage between the components and discourages hot gas ingestion from the primary flowpath to the secondary flowpath.

As noted above, the mounting slot 27 passes through the outer wall 22, the transition wall 29, and the forward wall 24. The shroud segments 18 thus incorporate a substantial amount of open area. There is not an air seal present between the perimeter of the mounting slot 27 and the hanger 46, and the shroud segments 18 do not, in and of themselves, function as plenums. Rather, the shroud segments 18 form a plenum in cooperation with the hangers 46, indicated generally at "P" in FIG. 1. Specifically, an annular sealing contact is present between the forward bearing surface 66 and the forward wall 24 of the shroud segment 18. Also, an annular sealing contact is present between the aft bearing surface 70 and the aft wall 26 of the shroud segment 18. The sealing contact is ensured by the spring action of the aft inner leg 68 as described above. The shroud segments 18 may be considered to be the "inner portion" of the plenum and the hangers 46 may be considered to be the "outer portion" thereof.

A hollow metallic impingement baffle 96 is disposed inside each shroud segment 18. The impingement baffle 96 fits closely to the retainer 48. The inboard wall of the impingement baffle has a number of impingement holes 98 formed therein, which direct coolant at the segment 18. The interior of the impingement baffle 96 communicates with the coolant feed passage 71 through a transfer passage 73 formed in the retainer 48.

In operation, air flows through passage 71, transfer passage 73, baffle 96, impingement holes 98, and pressurizes the plenum P. Spent cooling air from the plenum P exits through purge holes 100 formed in the forward wall 24 of the shroud segment 18.

The shroud mounting apparatus described above is effective to mount a low-ductility shroud in a turbine engine without applying clamping loads directly thereto, and has several advantages compared to the prior art.

In particular, the tapered edge (or wedge) shape on the forward side of the shroud allows the shroud mounting system to carry loads from forward of the shroud segments 18 to the turbine case 44 without transmitting directly through the shroud segments 18. By redirecting the load around the shroud segments 18, the stress in the shroud segments 18 remains relatively low.

Furthermore, the overhangs 32 and 34 allow the shroud segments 18 to protect the supporting structure close to the flowpath while discouraging hot gas ingestion through the use of overlaps between the shroud segments 18 and the axially adjacent nozzles. This overlapping configuration requires less cooling flow to purge the shroud-to-nozzle cavities, thereby improving overall engine performance. As the shroud material has better high temperature capability and lower stress than the adjacent nozzles, the use of the overhangs 32 and 34 provides an overall turbine life improvement.

Finally, the incorporation of the compound fillet 119 allows the interlaminar stress at the shroud segment wall intersections to be distributed over a larger area, thus reducing the peak interlaminar tensile stress value. Analysis has shown that the configuration described above can lower the peak interlaminar tensile stress by a significant amount, for example about 50% as compared to the configuration without the compound fillet, without significant changes to the primary in-plane (or fiber direction) stress.

The foregoing has described a turbine shroud apparatus for a gas turbine engine. While specific embodiments of the present invention have been described, it will be apparent to those skilled in the art that various modifications thereto can be made without departing from the spirit and scope of the invention. Accordingly, the foregoing description of the preferred embodiment of the invention and the best mode for practicing the invention are provided for the purpose of illustration only and not for the purpose of limitation.

What is claimed is:

1. A shroud segment for a gas turbine engine, the shroud segment constructed from a composite material including reinforcing fibers embedded in a matrix, and having a cross-sectional shape defined by opposed forward and aft walls, and opposed inner and outer walls, the walls extending between opposed first and second end faces, wherein the inner wall defines an arcuate inner flowpath surface; and wherein a compound fillet is disposed at a junction between first and second ones of the walls, the compound fillet including first and second portions, the second portion having a concave curvature extending into the first one of the walls, wherein the first portion represents an addition to a nominal thickness of the second wall.

2. The shroud segment of claim 1 wherein the thickness of the first wall is at a minimum within the second portion of the compound fillet.

3. The shroud segment of claim 1 wherein the first portion comprises a surface disposed at an acute angle to the first and second walls.

4. The shroud segment of claim 1 wherein the first wall is the inner wall.

5. The shroud segment of claim 1 wherein the second wall is the aft wall.

6. The shroud segment of claim 1 wherein the composite material comprises a ceramic matrix composite material.

7. A shroud apparatus for a gas turbine engine, comprising:

an annular metallic hanger;

a shroud segment disposed inboard of the hanger, the shroud segment constructed from a composite material including reinforcing fibers embedded in a matrix, and having a cross-sectional shape defined by opposed forward and aft walls, and opposed inner and outer walls, the walls extending between opposed first and second end faces, wherein the inner wall defines an arcuate inner flowpath surface; and wherein a compound fillet is disposed at a junction between first and second ones of the walls, the compound fillet including first and second portions, the second portion having a concave curvature extending into the first one of the walls, wherein the first portion represents an addition to a nominal thickness of the second wall; and a retainer mechanically coupled to the hanger which engages the shroud segment to retain the shroud segment to the hanger while permitting movement of the shroud segment in a radial direction.

8. The apparatus of claim 7 wherein the retainer includes a central portion with a pair of opposed arms extending laterally outward therefrom.

9. The apparatus of claim 7 wherein a surface of the retainer is clamped against the hanger, and the outer wall of the shroud segment is trapped between the hanger and a portion of the retainer.

10. The apparatus of claim 9 wherein a spring is clamped between the hanger and the retainer and resilient bears against the shroud segment so as to urge it radially inboard against the retainer.

11. The apparatus of claim 7 wherein the inner wall extends axially forward past the forward wall to define a forward overhang and the inner wall extends axially aft past the aft wall to define an aft overhang.

12. The apparatus of claim 7 wherein the hanger is surrounded and carried by an annular turbine case.

13. The apparatus of claim 12 wherein the hanger includes axially-spaced-apart forward and aft hooks which are received by forward and aft rails of the turbine case, respectively.

14. The apparatus of claim 7 wherein the shroud segment includes a transition wall disposed between the forward and outer walls and extending at acute angles to both the forward and outer walls.

15. The apparatus of claim 14 wherein the transition wall extends generally parallel to the body of the hanger.

16. The apparatus of claim 7 wherein the hanger includes a resilient aft inner leg which resilient loads the shroud segment axially forward against a bearing surface of a forward inner leg of the hanger.

17. The apparatus of claim 7 wherein the shroud segment comprises a ceramic matrix composite material.

18. The apparatus of claim 7 wherein an annular ring of shroud segments are arranged in an annular array within the casing.

* * * * *